US005088474A

United States Patent [19]

Mabuchi et al.

[11] Patent Number: 5,088,474

[45] Date of Patent: Feb. 18, 1992

[54] MASSAGER

[75] Inventors: Seiya Mabuchi; Tatsuo Katsunuma, both of Kashiwa, Japan

[73] Assignee: Bio Pit Co., Ltd., Chiba, Japan

[21] Appl. No.: 449,551

[22] Filed: Dec. 11, 1989

[30] Foreign Application Priority Data

Dec. 28, 1988 [JP] Japan ..... 63-332308
Jan. 13, 1989 [JP] Japan ..... 1-7132

[51] Int. Cl.[5] ..... A61H 7/00

[52] U.S. Cl. ..... 128/52; 128/32; 128/44; 128/51

[58] Field of Search ..... 128/24.1-24.5, 128/32, 43, 44, 51, 52, 54, 55, 67

[56] References Cited

U.S. PATENT DOCUMENTS 1,579,679 4/1926 Wahrt ..... 128/51
2,683,451 7/1954 Clark ..... 128/51
4,291,685 9/1981 Taelman ..... 128/24.1
4,730,605 3/1988 Noble et al. ..... 128/44 X

FOREIGN PATENT DOCUMENTS 1126798 11/1956 France ..... 128/44
0046251 2/1909 Switzerland ..... 128/24.3

*Primary Examiner*—Richard J. Apley
*Assistant Examiner*—Joe H. Cheng
*Attorney, Agent, or Firm*—McGlew & Tuttle

[57] ABSTRACT

A hand-held massager having a plurality of attachments; all the attachments being driven by a single drive unit via a rotating cam so that massaging is effected by increasing the massaging range and gently patting the skin surface.

6 Claims, 9 Drawing Sheets

MASSAGER

BACKGROUND OF THE INVENTION (1) Field of the Invention

This invention relates generally to a massager, and more specifically to a hand-held massager which repeatedly and gently pats the skin surface by the resiliency of springs by sequentially and repeatedly giving reciprocal motion to a plurality of attachments.

(2) Description of the Prior Art

Massagers which give stimuli to the skin and muscles by repeatedly patting the skin surface to the benefits of beauty and health are well known.

Massagers of the conventional type mostly consist of a single attachment that repeatedly pats the skin surface by giving reciprocal motion to the attachment to cause the stored energy in a resilient body, such as a spring, to be quickly released. The massager of the conventional type would therefore repeatedly gives massaging motion to a fixed location of the skin surface unless the massager is moved. The frequency of patting motion cannot be freely reduced.

The above problems can only be solved by providing a plurality of attachments. With the conventional type of massagers, however, a separate drive unit has to be provided independently to each attachment, resulting in an increase in the size of massagers.

In addition, with the conventional type of massager, in which the energy stored in resilient bodies, such as springs, is quickly released, there can be a problem of giving too strong a patting motion to a location where the subcutaneous muscular layer is thin, such as the head.

SUMMARY OF THE INVENTION

It is therefore an object of this invention to provide a compact hand-held massager in which massaging action is effected by expanding the massaging range and gently patting the skin surface with a plurality of attachments driven by a single drive unit.

It is another object of this invention to provide a compact hand-held massager in which the pushing force of each resilient body provided on a plurality of attachment shafts by means of a pushing force adjusting dial so as to make it possible to comfortably massage the skin surface.

It is still another object of this invention to provide a compact hand-held massager which is adapted to prevent uncomfortable mechanical noises due to unwanted collisions of lift arms generated at the time of release of springs. The lift arms pass over the crests of a rotating cam for causing a plurality of attachments to reciprocate by providing a steep slope on the surface of the rotating cam at an area where the lift arms pass over the crest of the rotating cam. One of the characteristics of a massager of this invention are the a plurality of attachments are provided for pushing the skin surface, a drive unit for causing the attachments to reciprocate, energy storage means consisting of resilient bodies, such as springs, for storing energy when compressed by the reciprocating attachments, and attachment spacers for controlling the reciprocating range of the attachments. The energy storage means accumulates energy as the attachments are caused to retract, and releases the accumulated energy as the attachments are caused to move forward. Each of the attachments has an independent energy storage means, a rotating cam which is engaged with each of the attachments and has varied thicknesses in the reciprocating direction of the attachments at the rotating angular positions of the cam corresponding to the positions of the attachments so that the positions of the attachments in the reciprocating direction can be sequentially changed in accordance with the rotating angular positions of the cam is provided; the attachments being sequentially driven by causing the rotating cam to rotate by the drive unit.

These and other objects, features and advantages of the present invention will be better understood from the following description of the invention with reference to the accompanying drawings.

DESCRIPTION OF THE PREFERRED EMBODIMENTS

Figure 1A:
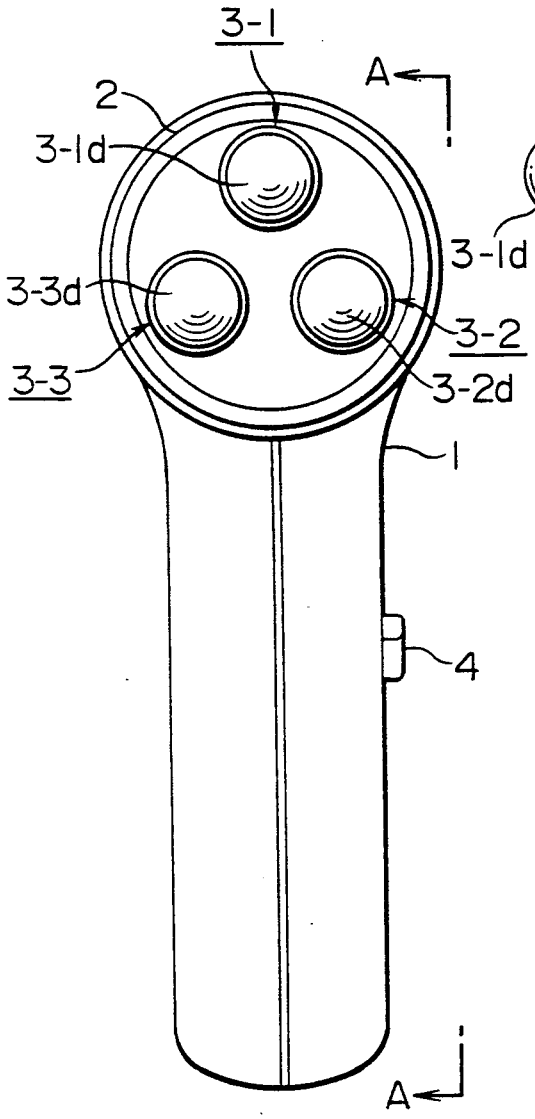
FIG. 1A being a front view, and FIG. 1B a side elevation taken along line A—A shown in FIG. 1A.
Figure 1B:
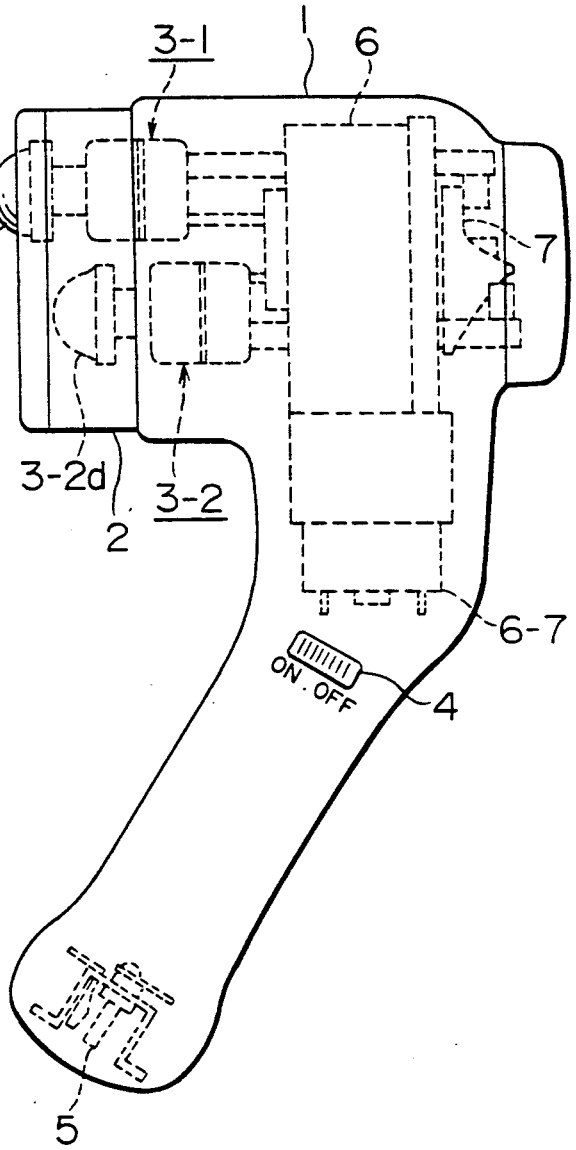
FIG. 1 is an outline drawing of an embodiment of this invention.

The embodiment shown in FIGS. 1A and 1B has three pushing attachments 3-1 through 3-3 sequentially reciprocated by a drive unit 6 mounted inside a massager housing 1 which can be held by a hand (the operation of the drive unit 6 will be described later, referring to FIGS. 2 through 5); pushing portions 3-1*d* through 3-3*d* consisting of a resilient member, such as rubber, mounted on the tip of the attachments 3-1 through 3-3 for patting and pushing the skin surface.

In the figure, reference numeral 2 refers to an attachment spacer; 3-1 through 3-3 to pushing attachments; 3-1*a* through 3-3*a* to attachment shafts; 3-1*b* through 3-3*b* to lift arms; 3-1*c* through 3-3*c* to attachment connections; 3-1*d* through 3-3*d* to pushing portions; 3-1*e* through 3-3*e* to attachment cushioning portions; 3-1*f* through 3-3*f* to locking pins; 4 to a pushbutton switch; 5 to a power input jack; 6 to a drive unit; 6-1 to a main shaft; 6-2 to a first gear shaft; 6-3 to a main gear; 6-4 to a second gear shaft; 6-5 to a first pinion gear; 6-6 to a crown gear; 6-7 to a motor; 6-8 to a motor shaft; 6-9 to a second pinion gear; 6-10 to a spring housing; 6-11 to a drive unit housing; 7 to a cylindrical rotating cam; 8-1 through 8-3 to springs; and 9-1 through 9-3 to spring fixing pins, respectively.

In this construction, wiring (not shown) is provided appropriately to connect a pushbutton switch 4, a power input jack 5, and a motor 6-7 to the drive source of a drive unit 6. When power is fed to the power input jack 5, the massager shown in FIG. 1 is operated through the control of the pushbutton switch 4. The massager accomplishes massaging action in the state where the end face of a cylindrical attachment spacer 2 mounted on the tip of a massager housing 1 comes in contact with the skin surface. In FIG. 1, an attachment 3-1 is shown in the most forwarded state while an attachment 3-2 is shown in the retracted state. That is, pushing portions 3-1*d* through 3-3*d* provided on the tip of the attachments 3-1 through 3-3 are adapted to be protruded slightly from the end face of the attachment spacer 2. By sequentially reciprocating the attachments 3-1 through 3-3 by the drive unit 6, the pushing portions 3-1*d* through 3-3*d* are sequentially an repeatedly pat and push the skin surface to effect massaging action. Since the reciprocating stroke of the attachments 3-1 through 3-3 is uniform, and massaging is accomplished in the state where the end face of the attachment spacer 2 comes in contact with the skin surface, the pushing force of the pushing portions 3-1*d* through 3-3*d* onto the skin surface also becomes uniform. That is, since the protruded distance of each of the pushing portions 3-1*d* through 3-3*d* from the end face of the attachment spacer 2 is always constant, the pushing force of each of the pushing portions 3-1*d* through 3-3*d* onto the skin surface becomes uniform by massaging in the state the end face of the attachment spacer 2 is brought into contact with the skin surface.

In the foregoing, description has been made on the basic construction and operation of the embodiment shown in FIG. 1. Now, the operation of the attachments 3-1 through 3-3 will be described more specifically in the following, referring to FIGS. 2 through 5.

Figure 2:
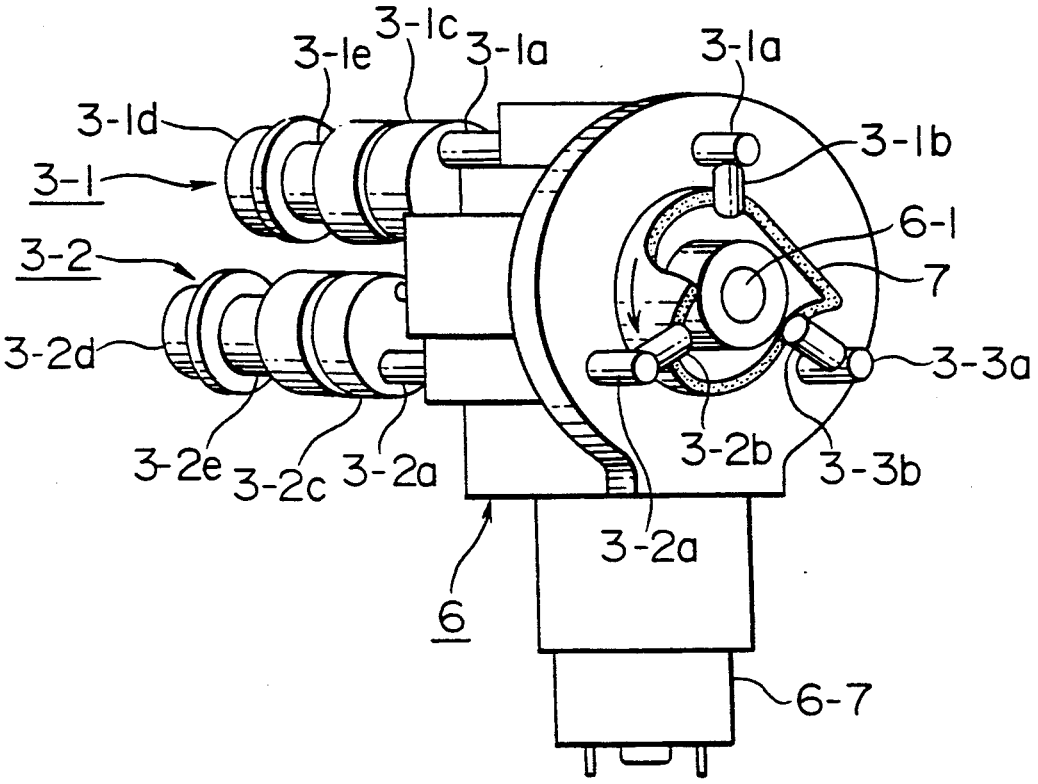
FIG. 2 is a perspective view of the essential part of the embodiment shown in FIG. 1.
Figure 3:
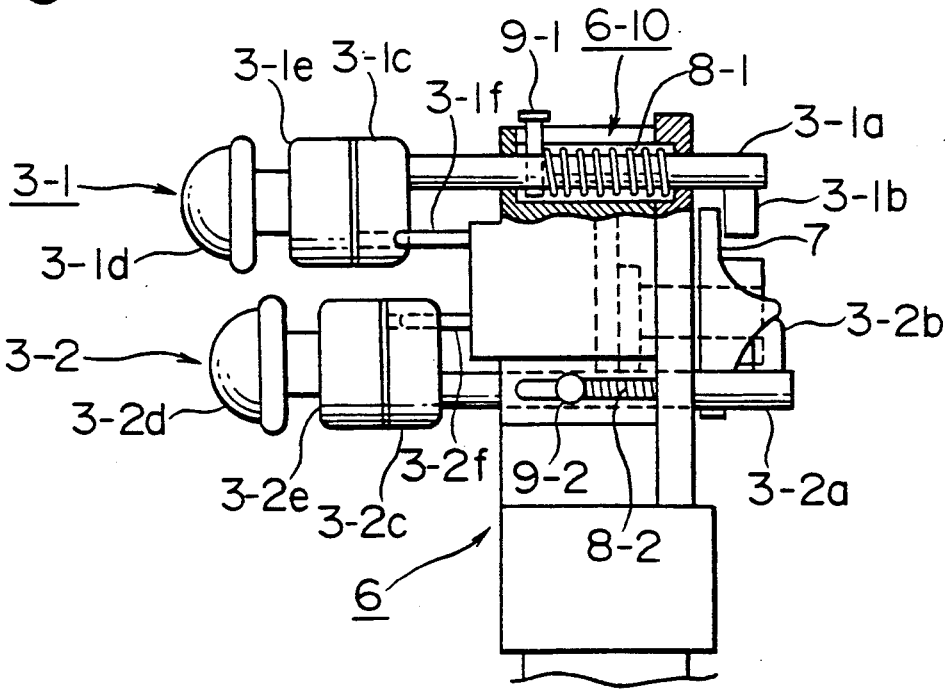
FIG. 3 is a partially cross-sectional side elevation of the embodiment shown in FIG. 2.

In FIGS. 2 and 3, the attachment 3-1 consists of an attachment shaft 3-1*a*, a lift arm 3-1*b* fixedly fitted to the attachment shaft 3-1*a* and engaged with a cylindrical rotating cam 7, an attachment connection 3-1*c* fixedly fitted to the attachment shaft 3-1*a* via a magnet or screw (not shown), for example, a pushing portion 3-1*d*, and an attachment cushioning portion 3-1*e* to which the pushing portion 3-1*d* is detachably mounted, and which is connected to the attachment connection 3-1*c* via a spring or cushioning material (not shown), for example. The attachment 3-1 is disposed in such a manner that the attachment 3-1 is passed through a spring housing 6-10 provided on part of a drive unit housing 6-11, together with a spring 8-1 which is passed through the attachment 3-1 and an end of which is engaged with a spring locking pin 9-1. In the foregoing, description has been made on the attachment 3-1, but the other attachments 3-2 and 3-3 have the same construction as the attachment 3-1; and the attachments 3-1 through 3-3 are disposed in such a manner that the axial centers thereof are disposed on the circumference of a circle. Locking pins 3-1*f* through 3-3*f* shown in FIG. 3 are means for preventing the attachments 3-1 through 3-3 from rotating.

Figure 4:
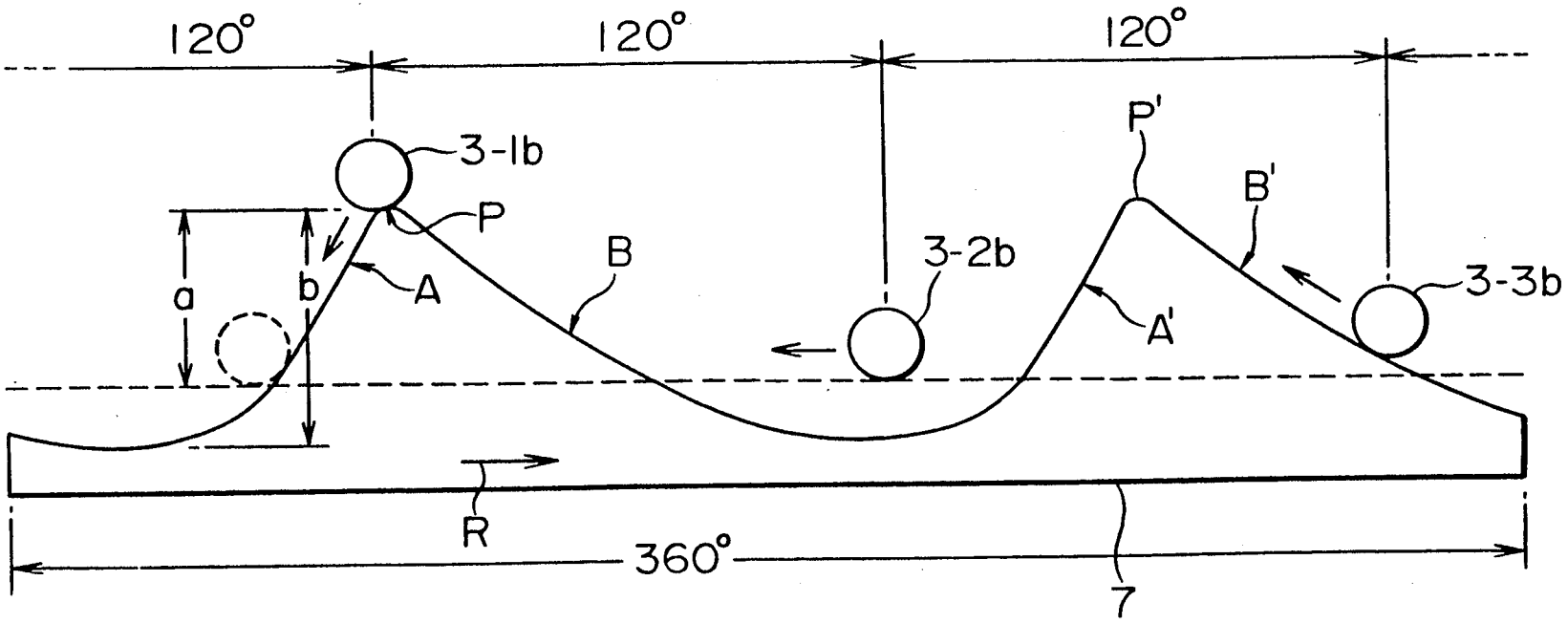
FIG. 4 is a developed side elevation of a cylindrical rotating cam shown in FIGS. 1 through 3.

The lift arms 3-1*b* through 3-3*b* are slidably engaged with the end face of the cylindrical rotating cam 7 which is fixedly fitted to a main shaft 6-1 as the output shaft of the drive unit 6, which will be described later with reference to FIG. 5, and rotated together with the main shaft 6-1. The end face of the cylindrical rotating cam 7 is formed in such a manner as to have a contour consisting of steep slopes A and A' and gentle slopes B and B', as shown in FIG. 4. FIG. 4 is a 360°-developed diagram of assistance in explaining the operation of the attachments 3-1 through 3-3, which illustrates the relative positions of the lift arms 3-1*b* through 3-3*b* with respect to the cylindrical rotating cam 7.

As the cylindrical rotating cam 7 is rotated, the lift arms 3-1*b* through 3-3*b* are moved while following the contoured end face of the cylindrical rotating cam 7. The cylindrical rotating cam 7 is rotated in the direction in which the lift arms 3-1*b* through 3-3*b* are moved from the gentle slope B (or B') to the crest P (or P') to the steep slope A (or A'), or in the counterclockwise direction in FIG. 2, or in the direction shown by arrow R in FIG. 4.

While the lift arm 3-1*b* moves up on the gentle slope B and reaches the crest P, the attachment shaft 3-1*a* (refer to FIG. 3) is retracted (refer to FIG. 3) and the spring 8-1 is compressed. And, as the lift arm 3-1*b* passes over the crest P and moves down along the steep slope A, the attachment shaft 3-1*a* is quickly forwarded by the springback of the spring 8-1, causing the pushing portion 3-1*d* to protrude from the attachment spacer 2 to push the skin surface. The intensity of the pushing force increases with increases in the inclination angle of the steep slope A, and with increases in the rotating speed of the cylindrical rotating cam 7. Arrow a in FIG. 4 denotes the stroke of the attachment shaft 3-1*a* during massaging, that is, in the state where the attachment spacer 2 is brought in contact with the skin surface, while arrow b in FIG. 4 denotes the free stroke of the attachment shaft 3-1*a*. When the inclination angle of the steep slope A is 90° (right angle), for example, the spring 8-1 is instantaneously released as the lift arm 3-1*b* passes over the crest P, causing continuous loud mechanical noises, giving discomfort to the user of the massager. In this invention, where a steep slope A is formed at a portion beyond the crest P, the springback of the spring 8-1 after the lift arm 3-1*b* passes over the crest P is restricted by the steep slope A to a gentle springback, preventing generation of uncomfortable mechanical noises.

In the foregoing, the operation of the attachment 3-1 has been described, but the operation of the attachments 3-2 and 3-3 is the same as that of the attachment 3-1. As shown in FIGS. 1 through 4, therefore, in which the number of attachments is three and the number of crests of the cylindrical rotating cam 7 is two, the number of repeated pushing actions onto the skin surface per revolution of the cylindrical rotating cam 7 becomes 6. That is, the skin surface at positions corresponding to the pushing portions 3-1*d* through 3-3*d* is sequentially pushed six times. The embodiment shown in FIGS. 1 through 4 is a massager having three attachments and a cylindrical rotating cam 7 having two crests. This invention is not limited to this construction, but the number of attachments may be two or more than four, and the number of crests may also be one or more than three. Although the pushing portions 3-1*d* through 3-3*d* in the embodiment shown in FIGS. 1 through 3 is formed into a semispherical shape, this invention is not limited to this shape, but may use the pushing portions formed into a plate, brush or other shape.

Next, an example of the drive unit 6 for driving the cylindrical rotating cam 7 will be described, referring to FIG. 5.

Figure 5:
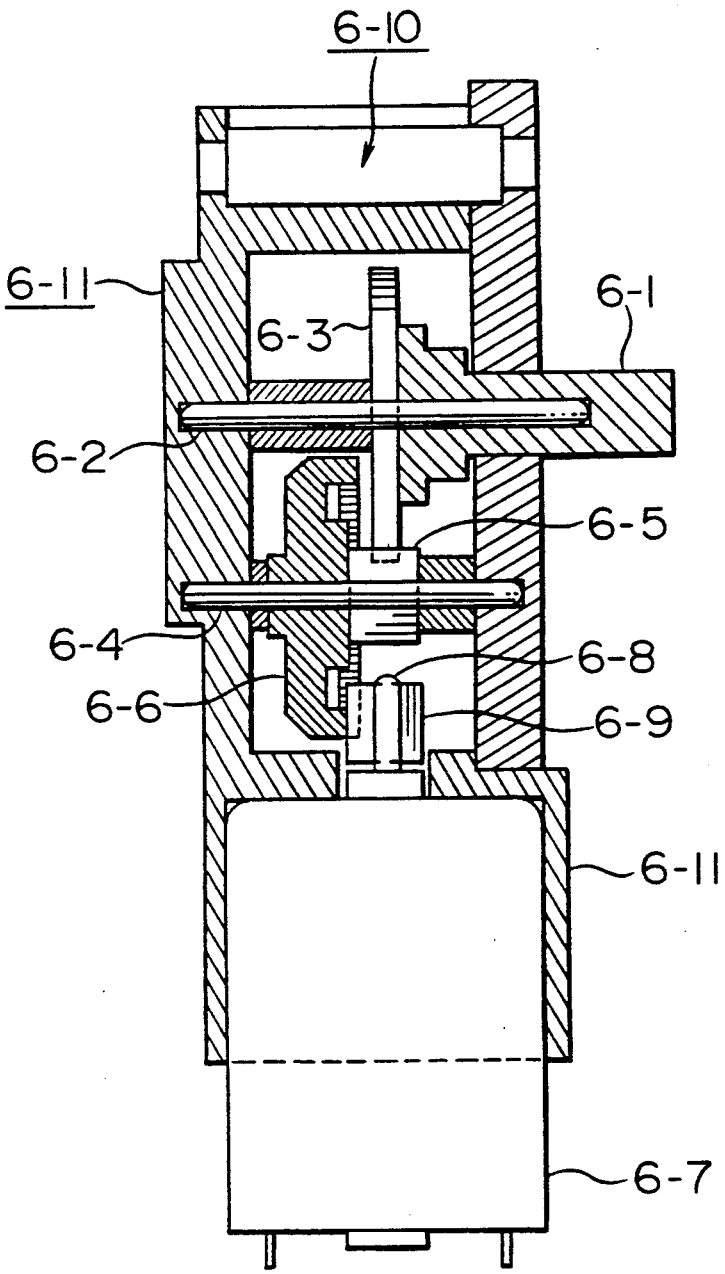
FIG. 5 is a cross-section of assistance in explaining a drive unit shown in FIGS. 1 through 3.

In FIG. 5, the main shaft 6-1 for driving the cylindrical rotating cam 7 (not shown) is fixedly fitted to the first gear shaft 6-2, to which the main gear 6-3 is fixedly fitted. To the second gear shaft 6-4, fixedly fitted are the first pinion gear 6-5, which is in mesh with the main gear 6-3, and the crown gear 6-6. Furthermore, the motor 6-7 is fixedly fitted to the drive unit housing 6-11, and the second pinion gear 6-9 fixedly fitted to the motor shaft 6-8 of the motor 6-7 is in mesh with the crown gear 6-6. Consequently, by driving the motor 6-7, the cylindrical rotating cam 7 is driven via the motor shaft 6-8, the second pinion gear 6-9, the crown gear 6-6, the first pinion gear 6-5, the main gear 6-3, the first gear shaft 6-2 and the main shaft 6-1. The spring housing 6-10 corresponds with the spring housing 6-10 shown in FIG. 3.

Figure 6B:
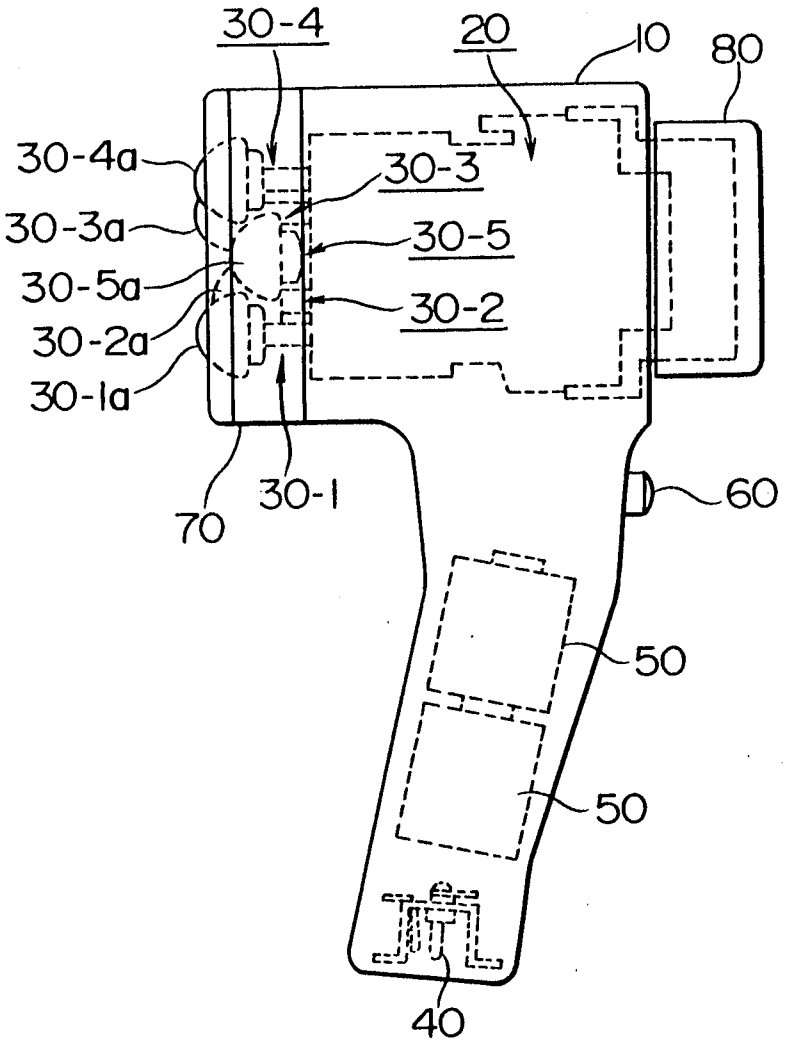
FIG. 6 is an outline drawing of another embodiment of this invention.
FIG. 6A being a front view, and FIG. 6B a side elevation taken along line A—A in FIG. 6A.
Figure 6A:
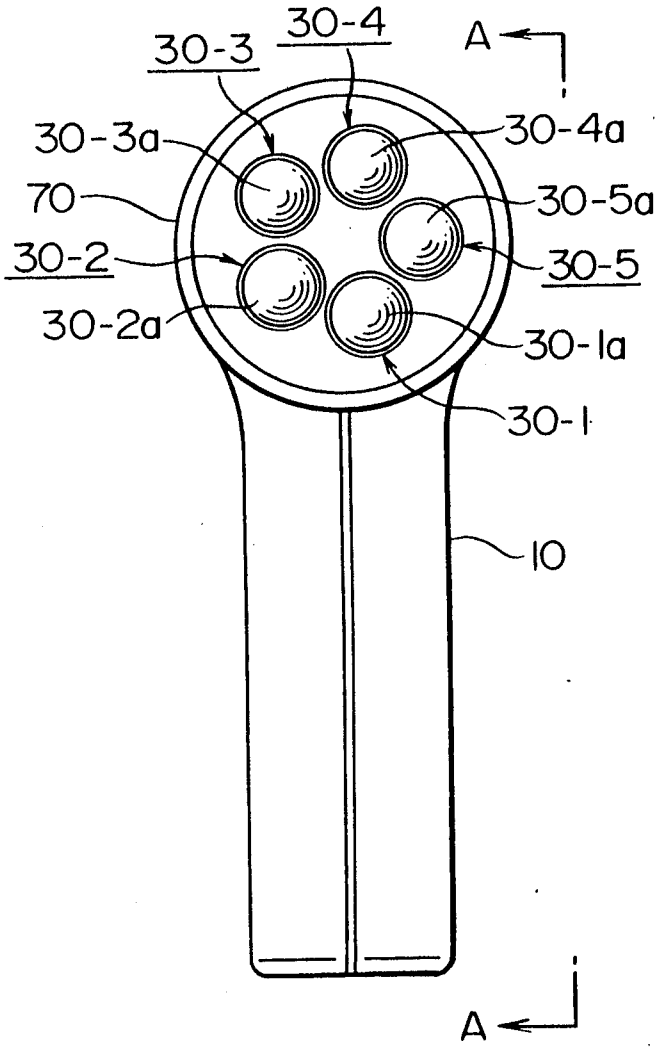

FIG. 6 shows another embodiment of this invention, in which five attachments 30-1 through 30-5 are provided, and the pushing portions 30-1*a* through 30-5*a* made of a cushioning material, such as rubber, are provided on the tip of these attachments, as in the case of the above-mentioned embodiment.

In the figure, reference numeral 20 refers to a drive unit; 40 to an input jack; 50 to a battery; 60 to a pushbutton switch; 70 to an attachment spacer; and 80 to a pushing force adjusting dial for adjusting the pushing force of the pushing portions 30-1*a* through 30-5*a* via the pushing force adjusting mechanism.

Figure 7A:
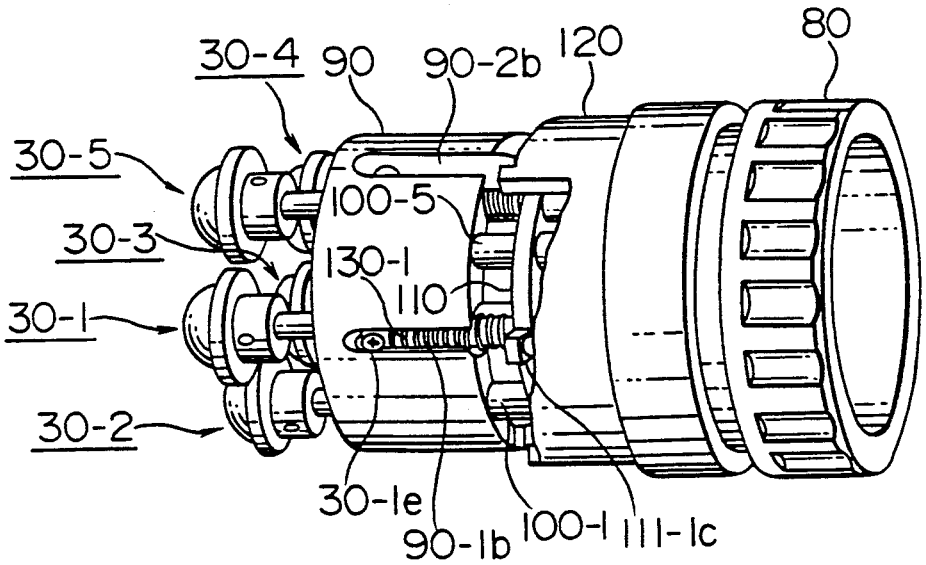
FIGS. 7A and 7B are perspective views of the essential part of the embodiment shown in FIG. 6.
Figure 7B:
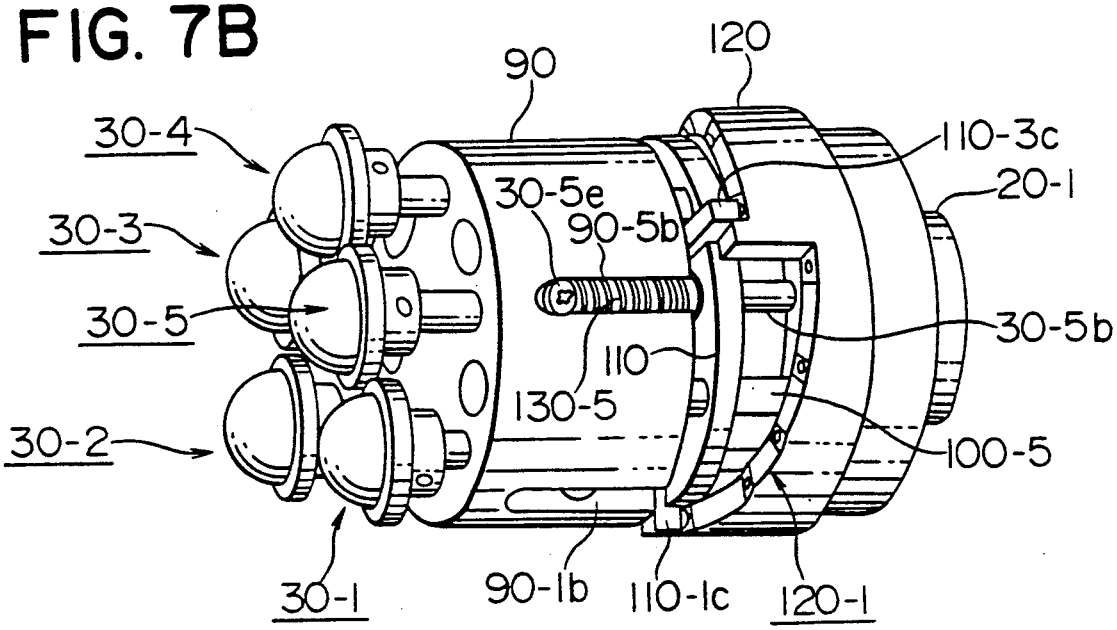
Figure 8:
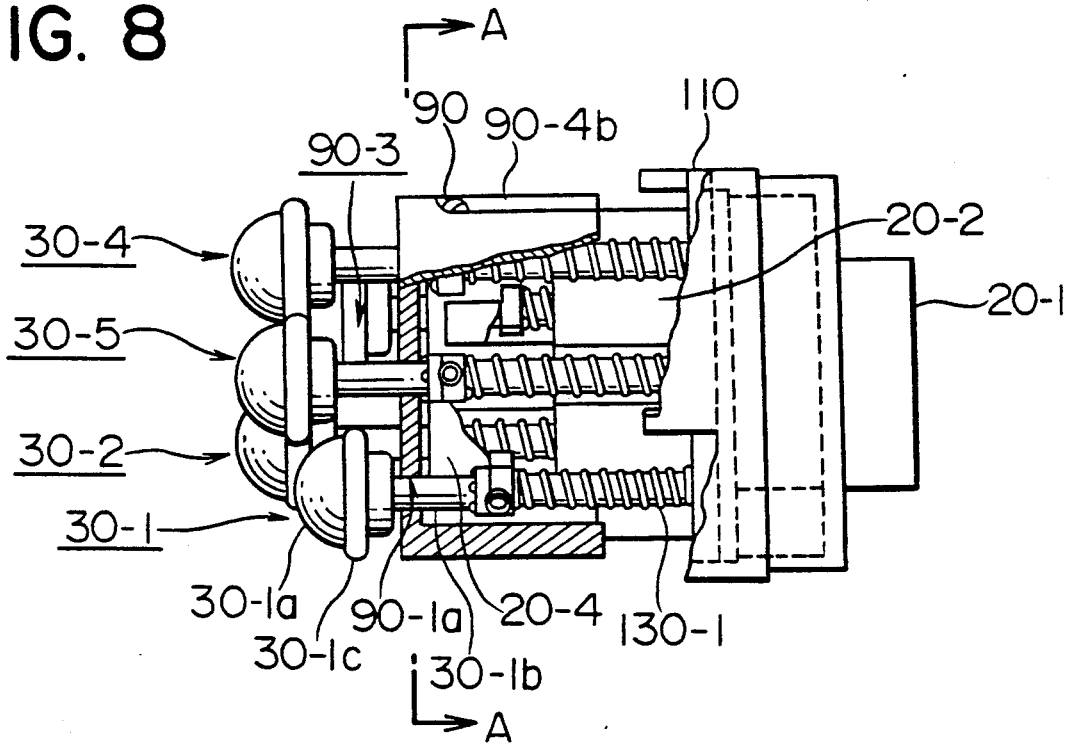
FIG. 8 is a partially cross-sectional side elevation of the embodiment shown in FIG. 7.
Figure 9:
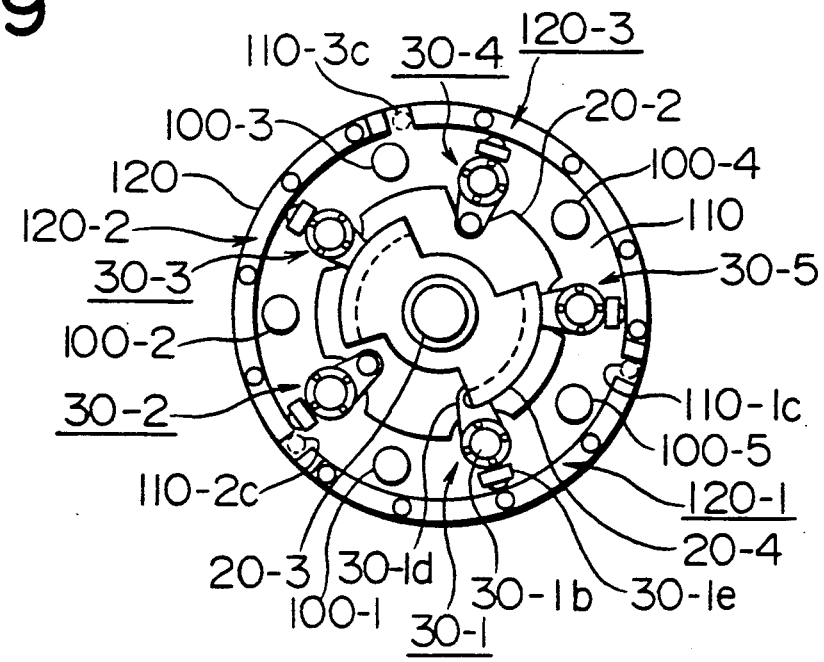
FIG. 9 is a diagram illustrating the construction of the essential part of the embodiment shown in FIG. 7, viewed from line A—A in FIG. 8, with the guide body removed.
Figure 10:
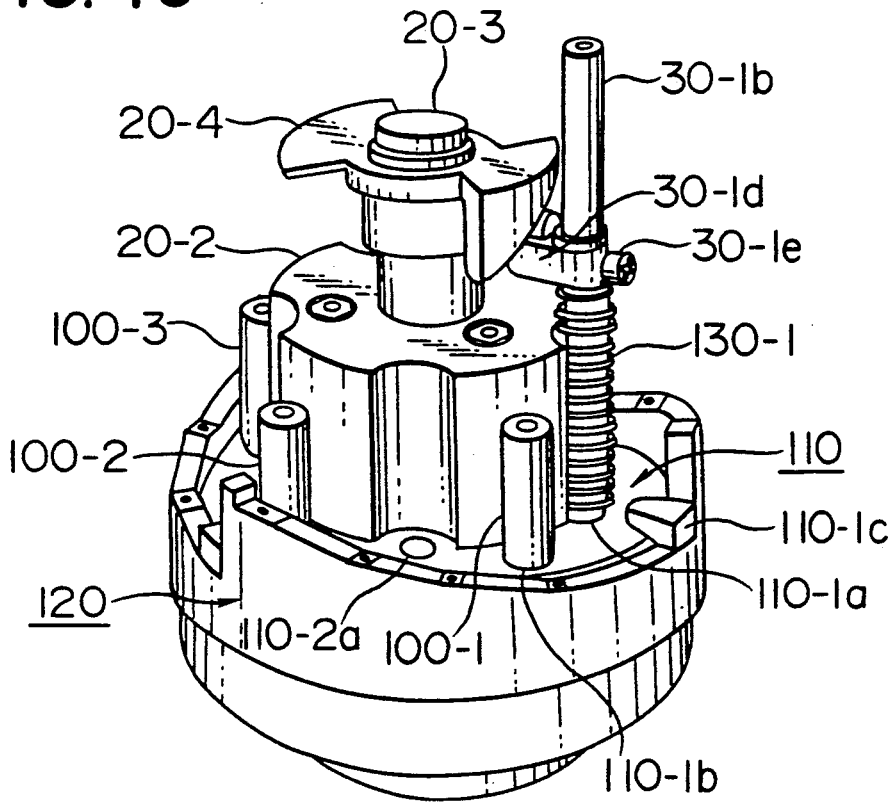
FIG. 10 is a perspective view illustrating part of the embodiment shown in FIG. 7 in greater detail.
Figure 11:
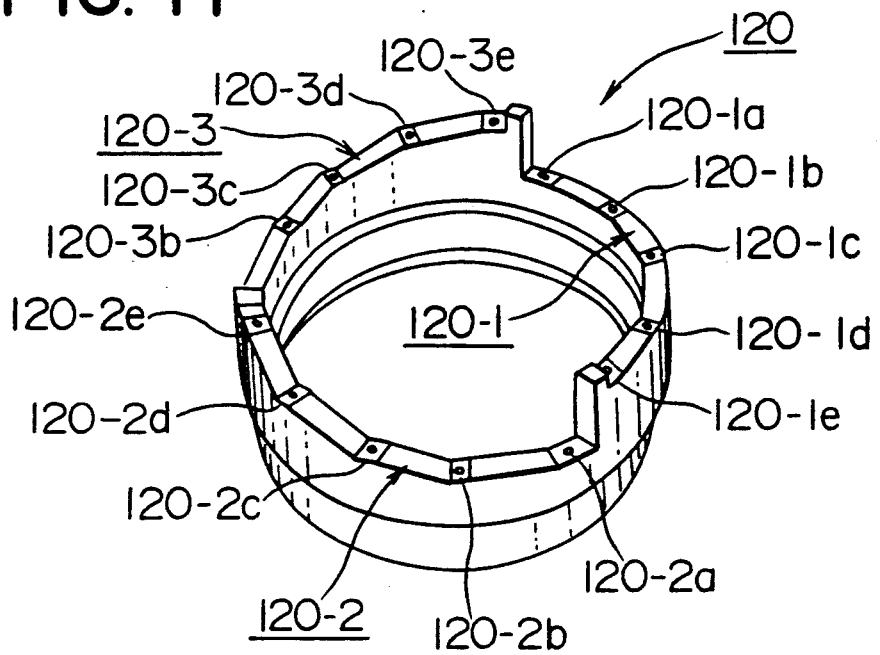
FIG. 11 is a perspective view of a pushing force adjusting cam in this invention.

In the foregoing, description has been made on the basic construction and operation of the embodiment shown in FIG. 6. In the following, the construction of the embodiment shown in FIG. 6 will be specifically described, referring to FIGS. 7 through 11. In figures other than FIG. 7A among FIGS. 7 through 11, the pushing force adjusting dial 80 is not shown. In FIG. 9, moreover, the pushing portions 30-1*a* through 30-5*a*, the pushing portion mounting seats 30-1*c* through 30-5*c*, which will be described later, and the guide body 90 are not shown. Furthermore, only the attachment 30-1 of the attachments 30-1 through 30-5 is shown in FIG. 10 to facilitate the understanding of the construction and operation. The construction of the embodiment shown in FIG. 6 will be described by classifying into the drive section, the attachment section, the guide section, and the pushing force adjusting mechanism section.

The drive section consists of a motor receptacle 20-1, a motor (not shown) fixedly fitted to the motor receptacle 20-1, a gear box 20-2 in which a motor output reduction mechanism (not shown) is housed, a main shaft 20-3 as the output shaft of the reduction mechanism, and a rotating cam 20-4 fixedly fitted to the main shaft 20-3.

The attachment section consists of five attachments 30-1 through 30-5 disposed on the circumference of a circle. The attachment 30-1 consists of an attachment shaft 30-1*b*, a pushing portion mounting seat 30-1*c* fixedly fitted to the tip of the attachment shaft 30-1*b*, a pushing portion 30-1*a* fixedly fitted to the pushing portion mounting seat 30-1*c*, a lift arm 30-1*d* fixedly fitted to the attachment shaft 30-1*b* and engaging with the rotating cam 20-4, as shown in FIG. 10, and a locking pin 30-1*e* for preventing the attachment 30-1 from rotating.

In the foregoing, the construction of the attachment 30-1 has been described, but the other attachments 30-2 through 30-5 have the same construction as the attachment 30-1.

The guide section consists of (i) a guide body 90 formed into a pot shape and having guide holes 90-1*a*, for guiding the attachment shafts 30-1*b*, and guide grooves 90-1*b*, for guiding the locking pins 30-1*e*, (ii) guide posts 100-1 through 100-5 for fixedly fitting the guide body 90 to the gear box 20-2.

The pushing force adjusting mechanism section consists of (i) a pushing force adjusting plate 110 formed into a ring and having guide holes 110-1*a*, for guiding the attachment shafts 30-1*b*, post guide holes 110-1*b*, for guiding the guide post 100-1 through 100-5, and engaging projections 110-1*c* through 110-3*c* for slidably engaging with a pushing force adjusting cam 120, which will be described later, (ii) springs 130-1, through which the attachment shafts 30-1*b*, are passed, and one ends of which come in contact with the lift arms 30-1*d*, and the other ends of which come in contact with the pushing force adjusting plate 110, (iii) a cylindrical pushing force adjusting cam 120 (see FIG. 11) adapted rotatably with respect to the gear box 20-2 and having inclined portions 120-1 through 120-3 which have engaging portions 120-1*a, b, c, d* and *e* through 120-3*a, b, c, d* and *e* engaging with the engaging projections 110-1*c* through 110-3*c* of the pushing force adjusting plate 110, and (iv) a pushing force adjusting dial 80 for rotating the pushing force adjusting cam 120.

Figure 12:
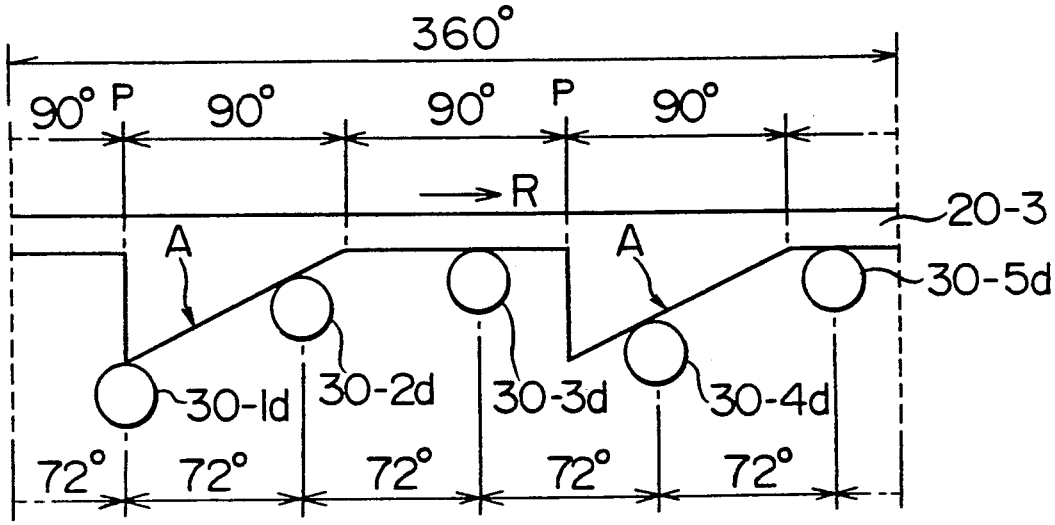
FIG. 12 is a developed side elevation of a rotating cam in this invention.
Figure 13:
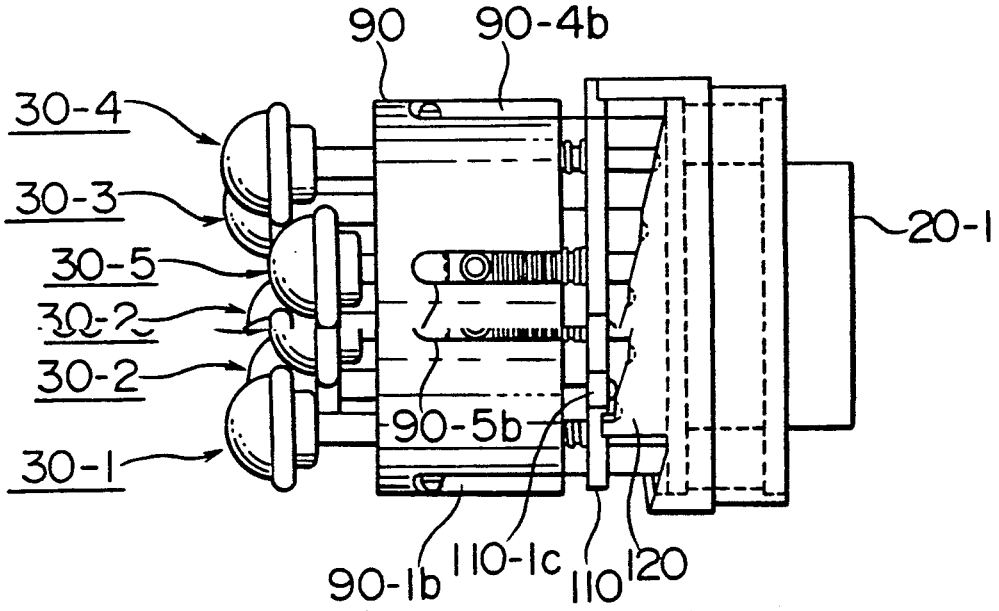
FIG. 13 is a diagram illustrating the pushing force adjusting function according to this invention.

The construction of the drive unit 20 has been described in the foregoing. Now, the operation of the attachments 30-1 through 30-5 and the pushing force adjusting operation will be specifically described with reference to FIG. 12 and FIG. 13, respectively. FIG. 12 is a developed diagram illustrating the relative positions of the lift arms 30-1*d* through 30-5*d* with respect to the rotating cam 20-4, of assistance in explaining the operation the attachments 30-1 through 30-5, and FIG. 13 is a diagram of assistance in explaining the pushing force adjusting operation.

The attachment 30-1 has such a construction that both ends of the attachment shaft 30-1*b* are slidably inserted into a guide hole 90-1*a* provided on the guide body 90 and a guide hole 110-1*a* provided on the pushing force adjusting plate 110, and the lift arm 30-1*d* is fixedly fitted to the attachment shaft 30-1*b* in such a manner that the lift arm 30-1*d* can be brought into contact with the rotating cam 20-4. The locking pin 30-1*e* is held by the resiliency of the spring 130-1 in such a manner that the locking pin 30-1*e* is slidably engaged with the guide groove 90-1*b* provided on the guide body 90. The other attachments 30-2 through 30-5 have the same construction as the attachment 30-1. As the rotating cam 20-4 rotates, the lift arm 30-1*d* through 30-5*d* move along the rotating cam 20-4 while making sliding contact with the end face of the rotating cam 20-4. The direction of rotation of the rotating cam 20-4 is counterclockwise (in the direction shown by arrow R in FIG. 12).

In FIG. 12, as the lift arm 30-1*d*, for example, moves along the slope A and reaches the crest P, the attachment shaft 30-1*b* is retracted, causing the spring 130-1 to be compressed. And as the lift arm 30-1*d* passes over the crest P, the attachment shaft 30-1*b* is quickly forwarded by the springback of the spring 130-1, and the pushing portion 30-1*a* protrudes slightly from the attachment spacer 70, patting and pushing the skin surface.

Although description has been made on the operation of the attachment 30-1, the operation of the attachments 30-2 through 30-5 is the same as that of the attachment 30-1. Consequently, the attachments 30-1 through 30-5 sequentially and repeatedly pat and push the skin surface in the order or the attachments 30-1, 30-4, 30-2, 30-5, 30-3, 30-1, as is evident from FIG. 12. Thus, massaging is accomplished.

In the foregoing, description has been made on a massager having five attachments and a rotating cam having two crests. This invention, however, is not limited to this construction, and the number of attachments and the number of crests of the rotating cam may be selsected appropriately. The pushing portion in the embodiment shown in FIG. 6 is formed into a semi-spherical shape, but this invention is not limited to this shape, and the pushing portion may be of a plate, brush or other shape.

Next, the pushing force adjusting function of this invention will be described. As already noted above in the description concerning the construction of the pushing force adjusting mechanism section, the pushing force adjusting plate 110 which comes in contact with an end each of the springs 130-1 through 130-5 has such a construction that the engaging projections 110-1*c* through 110-3*c* are engaged with the pushing force adjusting cam 120, and the pushing force adjusting plate 110 is slidable with respect to the attachment shafts 30-1*b* through 30-5*b* and the guide posts 100-1 through 100-5. Consequently, as the pushing force adjusting cam 120 is rotated by the pushing force adjusting dial 80, the position of the pushing force adjusting plate 110 can be moved vertically, as shown in the figure. With the change in the position of the pushing force adjusting plate 110, the amount of preloading of the springs 130-1 through 130-5 changes, causing the springback force of the springs 130-1 through 130-5 to change accordingly. That is, when the engaging projections 110-1*c* through 110-3*c* are engaged with the engaging portions 120-1*a* through 120-3*a* of the pushing force adjusting cam 120 (see FIG. 11) (in the state shown in FIG. 8), the amount of preloading of the springs 130-1 through 130-5 is reduced to the minimum. When the engaging projections 110-1*c* through 110-3*c* are engaged with the engaging portions 120-1*e* through 120-3*e* (in the state shown in FIG. 13), the amount of preloading of the springs 130-1 through 130-5 reaches the maximum. Thus, massaging with a desired pushing force can be effected by adjusting the state of engagement of the engaging projections 110-1*c* through 110-3*c* with the engaging portions of the pushing force adjusting cam 120 by adjusting the pushing force adjusting dial 80.

As described above, this invention makes it possible to provide a compact hand-held massager in which a plurality of attachments are provided, and the attachments are adapted to be driven by a single drive unit so as to increase the massaging range and gently massage the skin surface.

Furthermore, the massager of this invention can comfortably massage the skin surface with a desired pushing force since the pushing force of each resilient body provided on the attachment shafts can be adjusted by adjusting the pushing force adjusting dial.

In addition, the massager of this invention can achieve the effect of preventing uncomfortable mechanical noises from being generated as each lift arm operates while engaging with the rotating cam.

While the invention has been described in its preferred embodiments, it is to be understood that the words which have been used are words of description rather than limitation and that various changes may be made with the purview of the appended claims without departing from the true scope and spirit of the invention in its broader aspects.

What is claimed is:

1. A massager comprising:

pushing attachments;

drive means for reciprocating said pushing attachments, said drive means having a rotating cam means engaging with each of said pushing attachments, said rotating cam means formed in such a manner that a position of said pushing attachments in a reciprocating direction sequentially changes corresponding with a rotating angle position of said rotating cam means, a length of said reciprocation of said pushing attachments corresponding with a rotating angular position of said rotating cam means, said pushing attachments being sequentially driven by said rotating cam means, said rotating cam means having two crests, and a surface of said rotating cam means beyond each crest being inclined more steeply than said rotating cam means surface before each crest; and independent energy storage means for each pushing attachment storing energy when corresponding said pushing attachment is retracted and releasing said stored energy when said corresponding pushing attachment is moved forward; and an attachment spacer for controlling a range of said reciprocating pushing attachments.

2. A massager as set forth in claim 1 wherein: said pushing attachments are three in number.

3. A massager as set forth in claim 1 wherein each of said pushing attachments having a pushing portion is formed into a semi-spherical shape.

4. A massager as set forth in claim 1 wherein each of said pushing attachments having a pushing portion is attached to an attachment connection and an attachment cushioning portion.

5. A massager as set forth in claim 4, wherein:

said attachment cushioning portion is made of rubber.

6. A massager comprising:

a pushing attachment; and drive means for retracting said pushing attachment into the massager and for limiting movement of said pushing attachment out of the massager, the speed of said retracting of said pushing attachment into the massager being slower than the speed of said limiting of movement of said pushing attachment out of the massager.

* * * * *